US006126821A

United States Patent [19]

Corcoran

[11] Patent Number: 6,126,821

[45] Date of Patent: Oct. 3, 2000

[54] RAKED BAR SCREEN

[75] Inventor: Paul Corcoran, Marden, United Kingdom

[73] Assignee: T J Brent Limited, Kent, United Kingdom

[21] Appl. No.: 09/341,556

[22] PCT Filed: Jan. 20, 1998

[86] PCT No.: PCT/GB98/00167

§ 371 Date: Oct. 12, 1999

§ 102(e) Date: Oct. 12, 1999

[87] PCT Pub. No.: WO98/31882

PCT Pub. Date: Jul. 23, 1998

[30] Foreign Application Priority Data

Jan. 20, 1997 [GB] United Kingdom ..... 9701093

[51] Int. Cl.[7] ..... E03F 5/14; E02B 5/08

[52] U.S. Cl. ..... 210/159; 210/162; 210/413

[58] Field of Search ..... 210/159, 162, 210/413

[56] References Cited

FOREIGN PATENT DOCUMENTS

| | | |
|---|---|---|
| 42 15 002 | 12/1992 | Germany . |
| 195 15 924 | 10/1995 | Germany . |
| 1174915 | 12/1969 | United Kingdom . |
| WO 95 19471 | 7/1995 | WIPO . |

*Primary Examiner*—Thomas M. Lithgow
*Attorney, Agent, or Firm*—McDermott, Will & Emery

[57] ABSTRACT

A raked bar screen for a storm overflow comprises a grid of parallel spaced-apart bars (1) attached at their ends to a framework (2,3,14). A comb assembly (4,5,6) has teeth (5) which engage in the spaces between the grid bars (1). The comb assembly is longitudinally reciprocable, whereby the comb teeth can sweep longitudinally back and forth between the grid bars. The grid bars are shaped to provide a straight central portion (10) and longitudinal end portions (11, 12) which are angled in relation to the straight portion. In use, sweeping of the comb teeth between the grid bars at the angled end portions drives out entrapped solid matter.

6 Claims, 5 Drawing Sheets

RAKED BAR SCREEN

This invention relates to a raked bar screen for a storm overflow.

Typical sewage systems are designed to accommodate not only normal flows of waste water but also flows of storm water resulting from heavy rainfall, flooding and the like. In a typical system, a storm water overflow is positioned alongside a sewage pipe. In storm conditions, the level of water in the pipe rises and flows up through a horizontal bar screen and out over a weir for discharge into a receiving watercourse. In some installations, the bar screen is arranged vertically. The purpose of the bar screen is to filter out floating solid matter from the waste water and retain it in the sewage pipe, so that the receiving watercourse does not become polluted. To prevent blockage of the bar screen, comb-like devices have been designed to continuously sweep the longitudinal spaces between individual bars of the bar screen during storm conditions.

DE-A-4 215 002 discloses a raked bar screen for a storm overflow. The screen comprises a grid of parallel spaced-apart bars attached at their ends to a framework. A comb assembly is provided with teeth which engage in the spaces between the grid bars. The comb assembly is pivoted about a central point above the grid and is caused to swing to and fro by a drive unit. The comb teeth accordingly sweep longitudinally back and forth between the grid bars. While this system satisfactorily keeps the central part of the grid free from solid blockage, it tends to sweep solid matter to each longitudinal end of the grid. As this solid matter builds up at each end, the amplitude of swing of the comb assembly is reduced. Not only is the effectiveness of filtration of the screen reduced, but mechanical stresses build up in the linkage with the drive unit, and can lead to breakdown.

GB-A-2 310 382 discloses a sewage screen having at least one pocket extending downstream of at least some portions of the screen, in relation to an intended direction of flow, to accommodate inorganic debris. Portions of the screen may slant upwardly at the ends. However, the screen is arranged in an upwardly extending overflow shaft, so solid material tends to accumulate in the pockets rather than being swept along in the flow of the sewage conduit.

The present invention provides a solution to the foregoing problems.

According to the invention, there is provided a raked bar screen for a storm overflow, comprising a grid of parallel spaced-apart bars attached at their ends to a framework; a comb assembly having teeth adapted to engage in the spaces between the grid bars, the comb assembly being longitudinally reciprocable, whereby the comb teeth can sweep longitudinally back and forth between the grid bars from end to end; the grid bars being shaped to provide a straight central portion and longitudinal end portions which are angled in relation to the straight portion, whereby in use sweeping of the comb teeth between the grid bars at the angled end portions will drive out entrapped solid matter; the framework including a solid cap portion joined to the ends of the bars and extending transversely thereto, and having a flat underside; and the comb teeth each having leading and trailing edges, a flat top edge and a bottom edge, the comb teeth being positioned such that, at their extremity of travel, the leading edges protrude through the angled end portions of the bars, and the top edges contact and slide at least partly along the underside of the solid cap portion.

The grid is preferably arranged substantially horizontally. The end portions of the grid bars are preferably upturned at an acute angle a which is less than the acute angle B formed between the leading and trailing edges of the comb teeth with the central portion of the grid bars. At their extremity of travel, the leading edges of the comb teeth protrude through the angled end portions of the grid bars.

The solid cap portion which supports the ends of the grid bars preferably incorporates a knife edge arranged near each end of the grid bars so as to scrape adhered solid matter off the top edge of the comb teeth at their extremity of travel.

The raked bar screen preferably comprises two or more banks of grid bars in tandem, each being separated from the next by a solid cap portion, and each being longitudinally swept from end to end by a respective comb assembly.

The invention also provides a combined sewer overflow installation, comprising a sewage conduit, and a storm overflow conduit adjacent to at least part of the sewage conduit, wherein part of the sewage conduit is in communication with part of the storm overflow conduit via an overflow weir, and wherein a raked bar screen as defined above is arranged substantially horizontally above the part of the sewage conduit which is in communication with the storm overflow conduit, the grid bars being at substantially the same level as the top of the weir.

Reference is now made to the accompanying drawings, in which:

Figure 6:
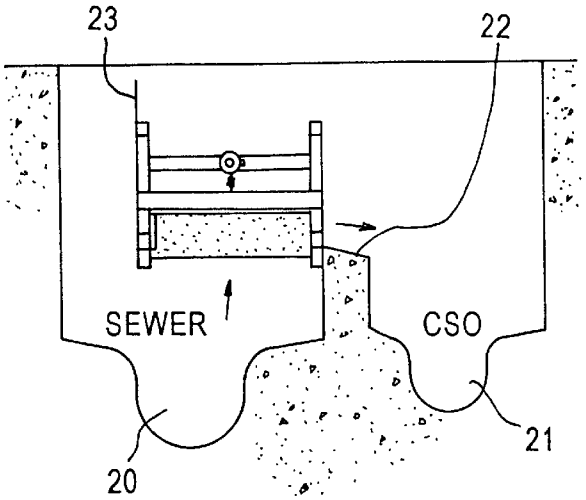
FIG. 6 is a transverse section on the line 6—6 of FIG. 5.
Figure 5:
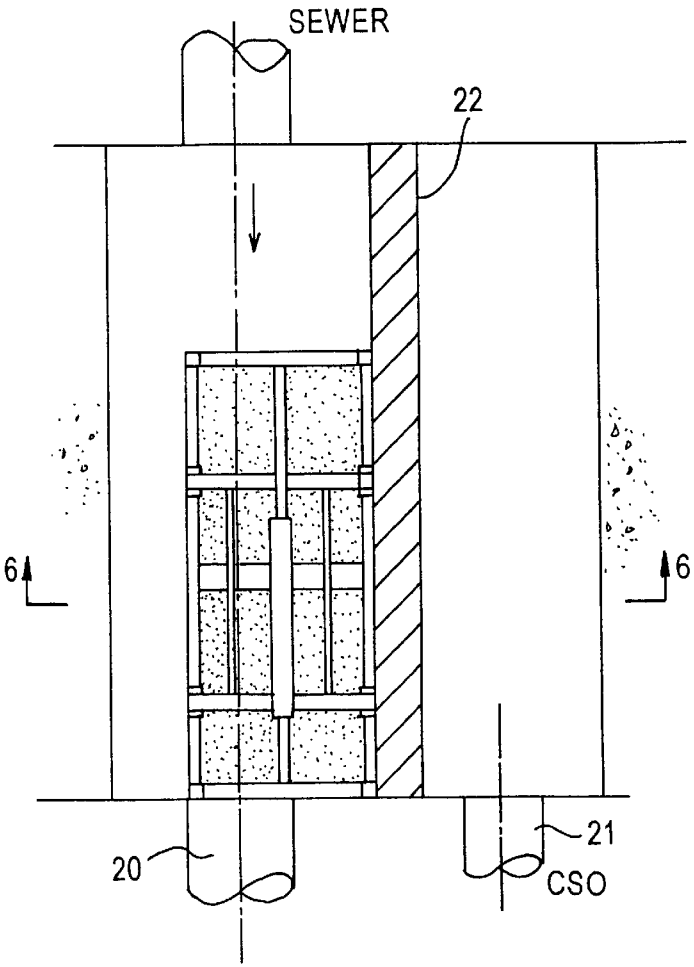
FIG. 5 is a plan view of a combined sewer overflow installation.

The drawings show a double raked bar screen in which two sets of grid bars are arranged end-to-end. This forms a single module, which can be joined with other modules if needed. The invention is, however, equally applicable to single grid bar systems and multiple grid bar systems. As shown in the drawings, two grids are each formed by an assembly of parallel spaced-apart grid bars I attached at their ends to a framework. The grid is arranged horizontally above a sewage conduit (as shown in FIGS. 5 and 6) so that, in storm conditions, as the water level rises the overflow of water is filtered by the grid. The framework comprises longitudinal lateral supports 2 and upstanding end supports 3.

A comb assembly comprises two transverse support bars 4, raised above the grid bars 1, and each supporting a line of underhanging comb teeth 5 of plastics material. The teeth 5 are mounted on the transverse support bar 4 in a spacing which corresponds to the spacing of the grid bars 1, and the teeth 5 engage respectively in the longitudinal spaces between successive grid bars 1. The transverse support bars 4 are linked by two longitudinal support bars 6. The two transverse support bars 4 cooperate respectively with the two sets of grid bars 1, so that the two sets of comb teeth 5 sweep the longitudinal spaces in the two arrays of grid bars 1, respectively. This is achieved by longitudinal reciprocation of the comb assembly. One of the transverse support bars 4 is joined by a linkage 7 to a hydraulic cylinder 8, mounted on a longitudinal support bar 9, mounted between the respective end members 3 of the supporting framework.

The hydraulic cylinder 8 is driven in reciprocating fashion on the support bar 9 by a supply of hydraulic fluid (not shown). The cylinder 8 in turn drives the comb assembly. The system is switched on and off in response to water level sensors.

Figure 1:
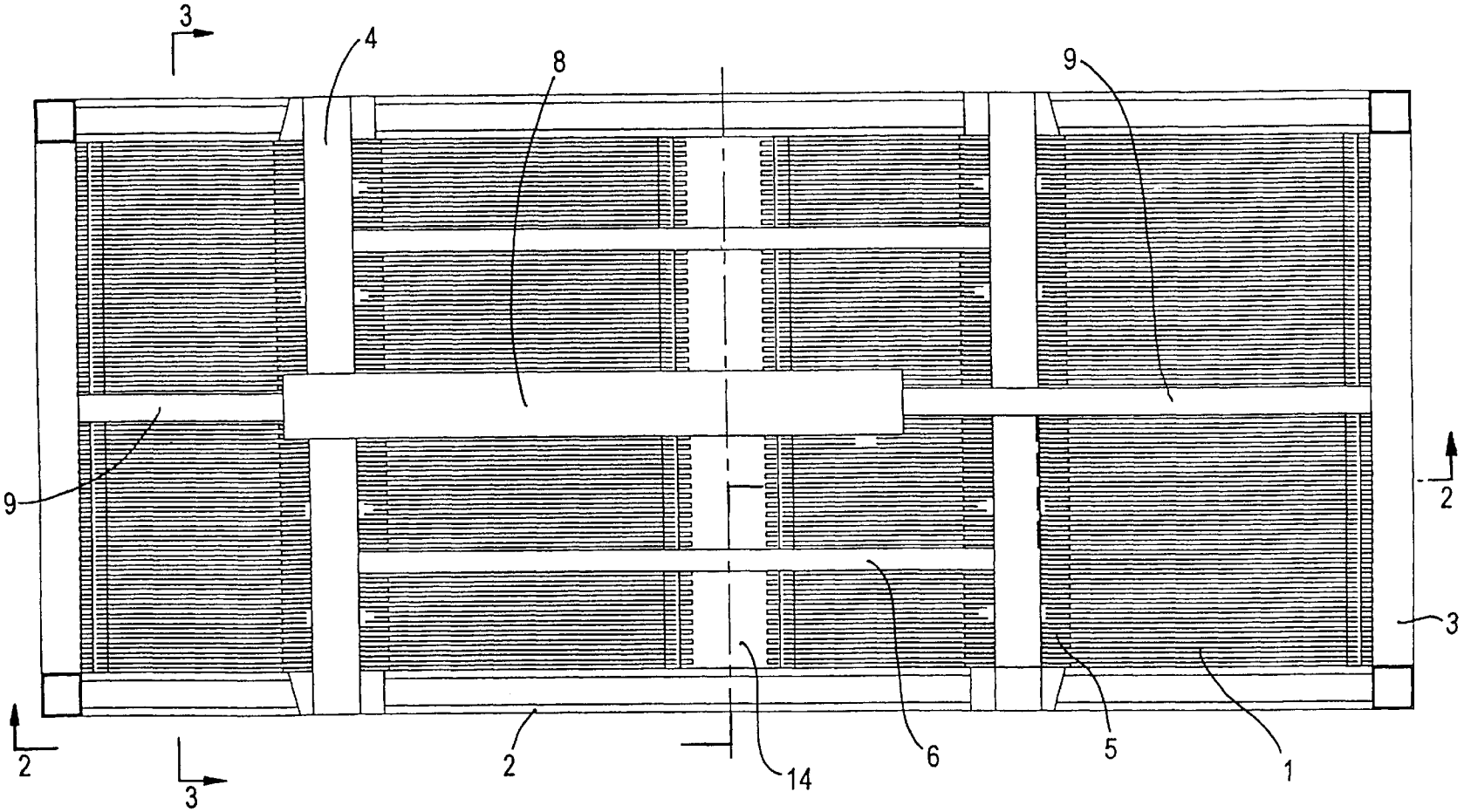
FIG. 1 is a plan view of a raked bar screen according to a preferred embodiment of the invention.
Figure 2:
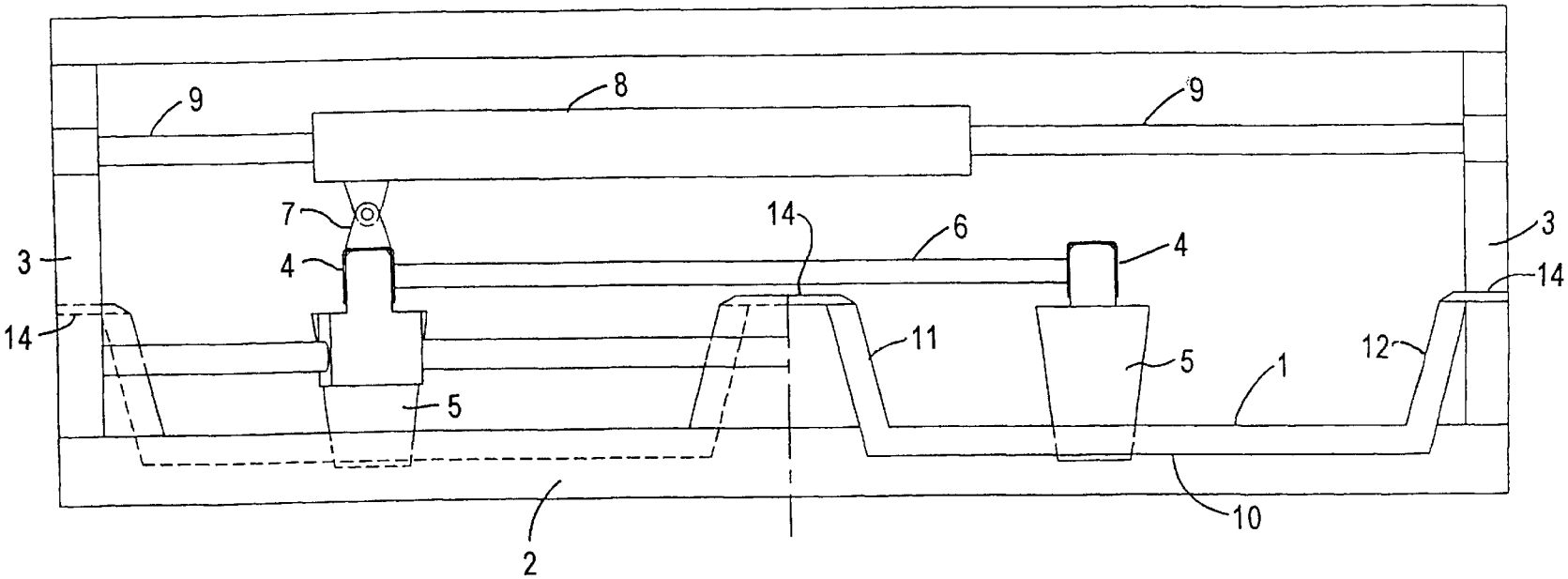
FIG. 2 is a side view in the form of a section on the line 2—2 of FIG. 1.
Figure 3:
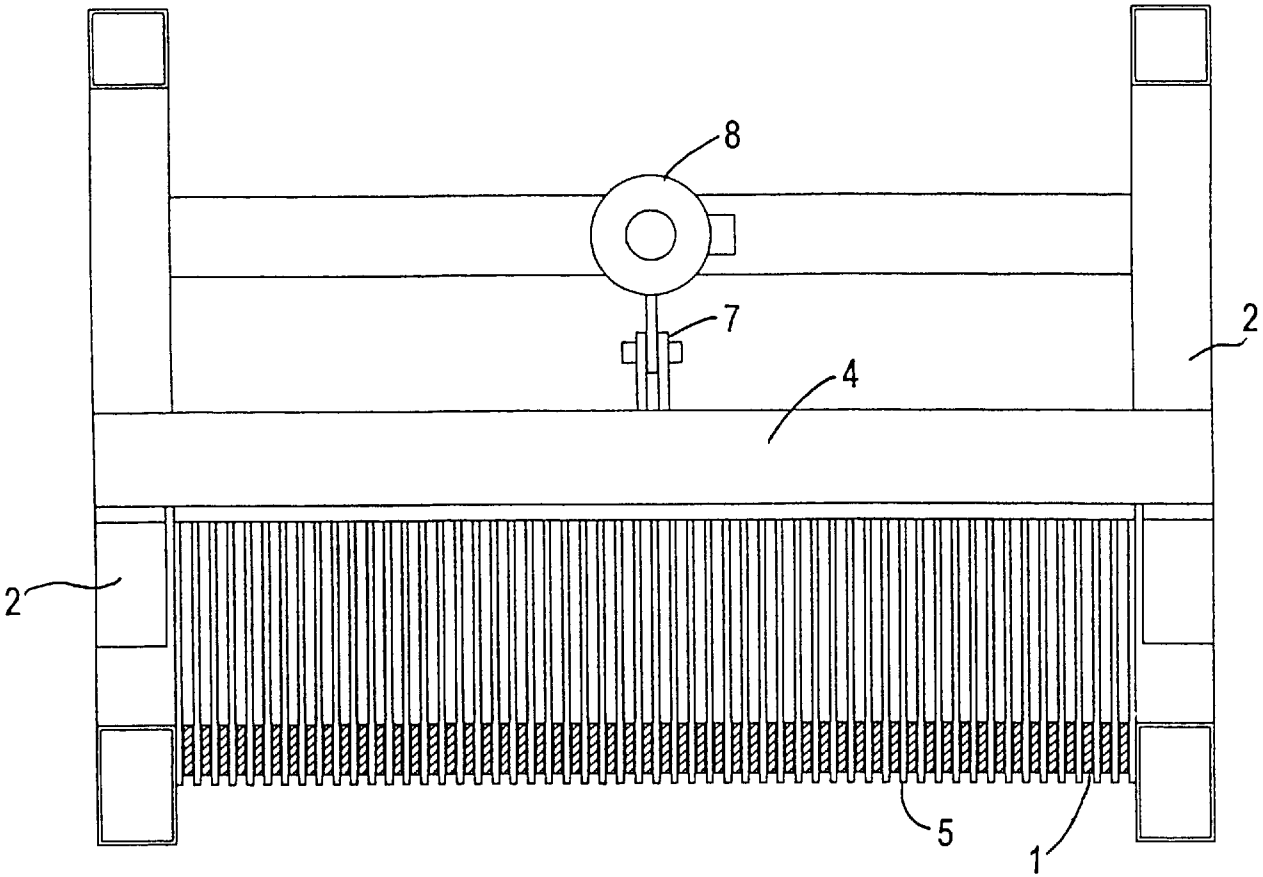
FIG. 3 is an end view in the form of a section on the line 3—3 of FIG. 1.
Figure 4:
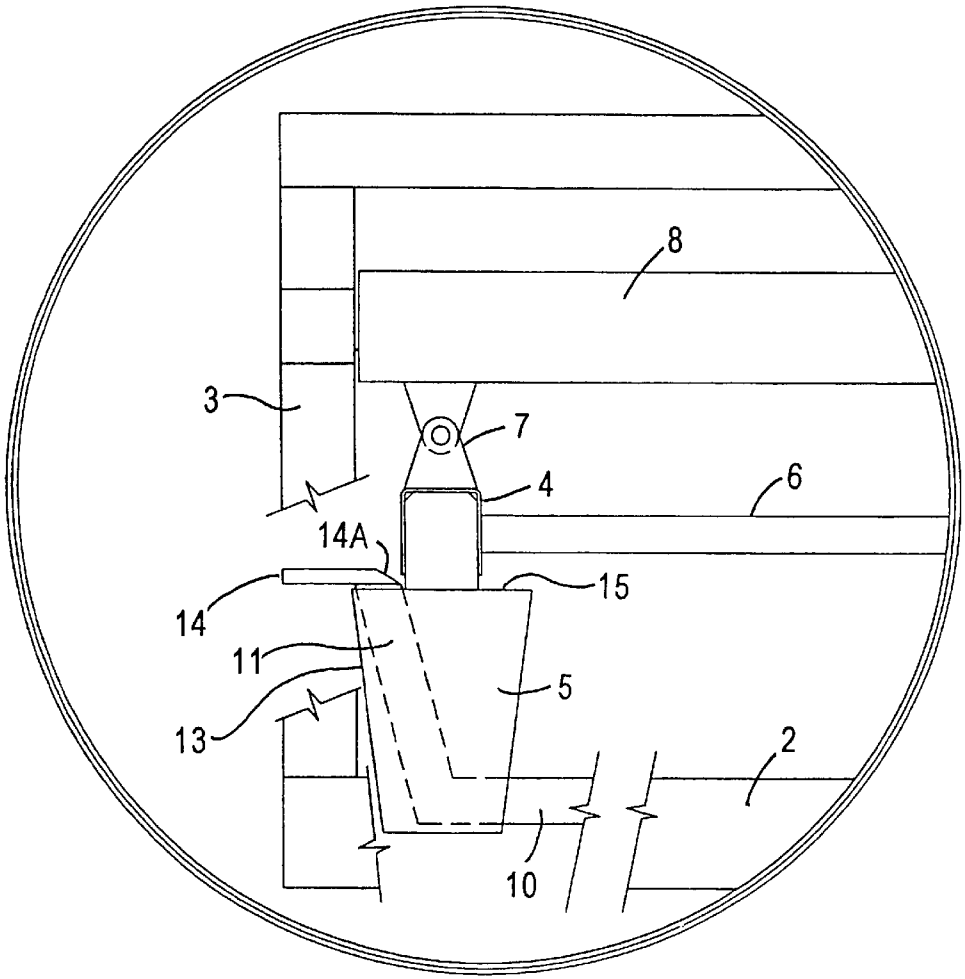
FIG. 4 is a detailed side view of part of the apparatus at full travel of the comb assembly.

As shown in FIG. 2, each of the grid bars I comprises a straight central portion 10 and an upturned portion 11,12 at each end. The end portions 11, 12 are upturned at an acute angle α in relation to the straight central portion 10. The leading and trailing edges 13 of the comb teeth 5 form an acute angle β with the central portion 10 of the grid bars. The angle β is greater than the angle α. At the extremity of travel of the comb teeth, shown in FIG. 4, the leading edge 13 of each comb tooth passes completely through the upturned end portion of the grid bars so as to protrude through to the other side. Together with the difference in the angles β and α, this ensures that solid matter entrapped between the grid bars is completely swept out by the comb teeth.

The longitudinal end of each set of grid bars is joined to a transversely extending solid cap 14, which terminates in a knife edge 14A adjacent the upper end of each upturned end portion of the grid bars, with the tip of the knife edge directed towards the central portion. The knife edge 14A is arranged to overlap with part of an upper surface 15 of the comb teeth 5. As a result, any solid matter which accumulates on the upper surface 15 is scraped off by the knife edge 14 at full travel of the comb teeth. The upper surface 15 of the comb teeth contacts and slides at least partly along the underside of the solid cap 14. As the grid bars are at the same level as the top of the weir (FIG. 6), solid material swept from between the bars by the comb teeth is immediately carried along by the flow of water in the sewage pipe.

FIGS. 5 and 6 show a sewage pipe 20 and storm overflow pipe 21 in a region where they communicate with each other. A weir 22 is arranged between them. A vertical baffle 23 above the sewer constrains overflow water to pass through a horizontally arranged raked bar screen (as described above). The raked bar screen is positioned between the vertical baffle 23 and the weir 22. The grid bars are at the same level as the top of the weir 22.

What is claimed is:

1. A raked bar screen for a storm overflow, comprising a grid of parallel spaced-apart bars attached at their ends to a framework; a comb assembly having teeth adapted to engage in the spaces between the grid bars, the comb assembly being longitudinally reciprocable, whereby the comb teeth can sweep longitudinally back and forth between the grid bars from end to end; the grid bars being shaped to provide a straight central portion and longitudinal end portions which are upturned and angled in relation to the straight portion, whereby in use sweeping of the comb teeth between the grid bars at the angled end portions will drive out entrapped solid matter; the framework including a solid cap portion (14) joined to the ends of the bars (1) and extending transversely thereto, and having a flat underside; and the comb teeth each having leading (13) and trailing edges, a flat top edge (15) and a bottom edge, the comb teeth being positioned Such that, at their extremity of travel, the leading edges (13) protrude through the angled end portions of the bars, and the top edges contact and slide at least partly along the underside of the solid cap portion.

2. A raked bar screen according to claim 1, in which the grid is arranged substantially horizontally.

3. A raked bar screen according to claim 2, in which the end portions of the grid bars are upturned at an acute angle α which is less than the acute angle β formed between the leading and trailing edges of the comb teeth with the central portion of the grid bars.

4. A raked bar screen according to claim 1, in which the solid cap portion incorporates a knife edge 14A adjoining the ends of the grid bars so as to scrape adhered solid matter off the top edge of the comb teeth at their extremity of travel.

5. A raked bar screen according to claim 1, comprising two or more banks of grid bars in tandem, each being separated from the next by a solid cap portion, and each being longitudinally swept from end to end by a respective comb assembly.

6. A combined sewer overflow installation, comprising a sewage conduit, and a storm overflow conduit adjacent to at least part of the sewage conduit, wherein part of the sewage conduit is in communication with part of the storm overflow conduit via an overflow weir, and wherein a raked bar screen according to claim 1 is arranged substantially horizontally above the part of the sewage conduit which is in communication with the storm overflow conduit, the grid bars being at substantially the same level as the top of the weir.

* * * * *